United States Patent [19]

Campbell et al.

[11] 4,084,142

[45] Apr. 11, 1978

[54] REED RELAY HAVING LOW DIFFERENTIAL THERMAL EMF

[75] Inventors: Bruce D. Campbell, Foster; Ralph Abrams, Warwick, both of R.I.

[73] Assignee: Coto-Coil Co., Inc., Providence, R.I.

[21] Appl. No.: 727,387

[22] Filed: Sep. 27, 1976

[51] Int. Cl.[2] ..... H01H 1/66

[52] U.S. Cl. ..... 335/152; 335/154

[58] Field of Search ..... 335/151, 152, 154, 217

[56] References Cited

U.S. PATENT DOCUMENTS

| | | | |
|---|---|---|---|
| 3,005,069 | 10/1961 | Sippach et al. | 335/152 |
| 3,456,216 | 7/1969 | Becker et al. | 335/154 X |
| 3,488,760 | 1/1970 | Julie | 335/154 |
| 3,701,960 | 10/1972 | Campbell | 335/154 |
| 3,812,439 | 5/1974 | Parmenter | 335/152 X |

*Primary Examiner*—George Harris

*Attorney, Agent, or Firm*—Salter & Michaelson

[57] ABSTRACT

A reed relay of the type having a pair of parallel reed switches aligned so that opposite ends of one switch are adjacent opposite ends of the other switch, the adjacent ends of said switches being in thermally conductive but electrically insulated relation with each other whereby the thermal EMF of the relay is eliminated or reduced to minimal levels.

8 Claims, 4 Drawing Figures

FIG. 1
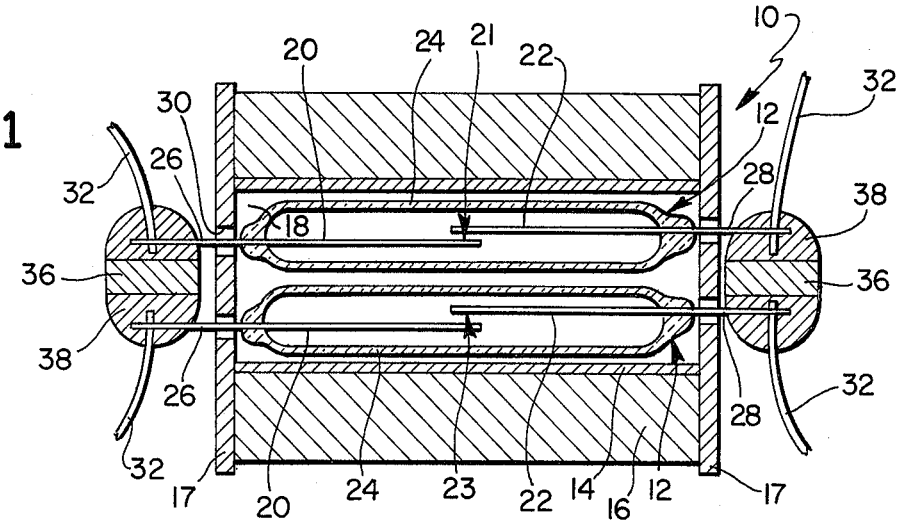
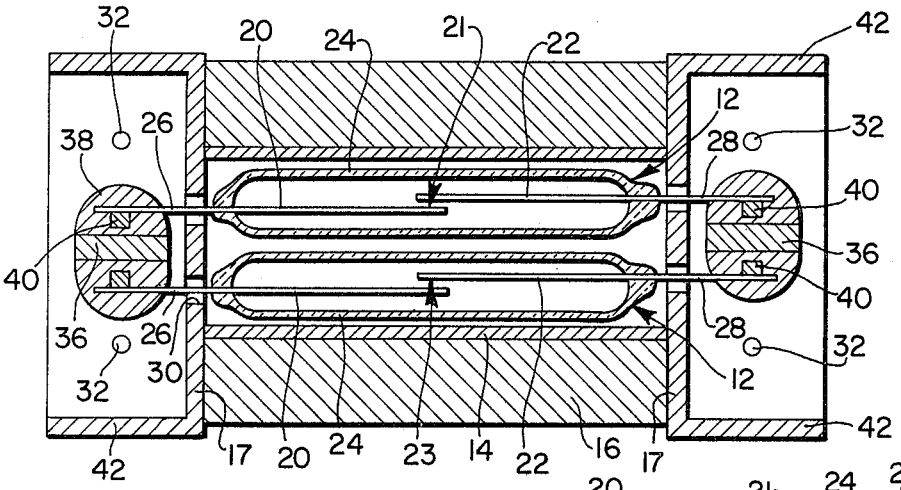
FIG. 2
FIG. 3
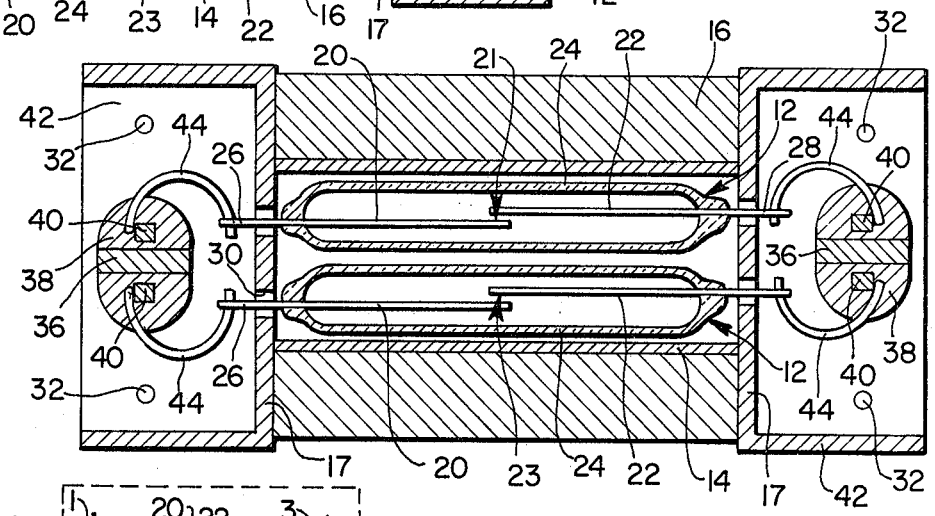
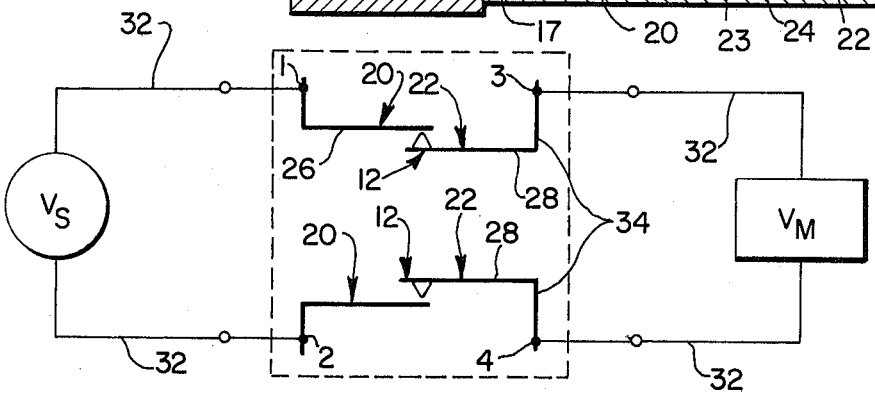
FIG. 4

REED RELAY HAVING LOW DIFFERENTIAL THERMAL EMF

BACKGROUND OF THE INVENTION

This invention relates to a reed relay where adjacent pairs of reed switches are utilized, as for low level voltage measurement and data scanning applications wherein two low-level signal lines are involved. Such reed switches generally are comprised of two flexible metal reeds hermetically sealed and supported in a glass enclosure so that the reeds are mechanically held apart except in the presence of a magnetic field in turn generally provided by a drive coil positioned about the enclosure or bobbin in which such reed switches are commonly housed. Such reeds generally consist of an iron-nickel alloy, i.e., "Niron". Extensions of the reeds are brought out through the glass enclosure at opposite ends thereof and form the ends of the reed switch. Thermal electrically-active junctions are formed when lead wires from an external circuit usually formed of copper or the like are connected to the iron-nickel ends of the reeds. When a temperature differential is created across these junctions such as may be created from heat dissipated in the drive coil, conductive air currents, and other such causes of ambient temperature gradients, a thermal EMF is generated which in many cases may be sufficiently large in proportion to the signal being measured or otherwise utilized so as to adversely affect operation of the relay. Accordingly it is highly desirable to eliminate or at least minimize to usable levels such thermal EMF effect.

It is known, for example, as disclosed in U.S. Pat. No. 3,456,216, to interconnect in series a pair of reed switches in such a fashion that the thermal junctions are made at the same end of the reed enclosure body and in this fashion temperature differentials and accordingly the thermal EMFs would be substantially reduced. It is also known in the art, as disclosed in U.S. Pat. No. 3,701,960, assigned to the assignee of the present application, to thermally interconnect the opposed outwardly extending leads of such a reed switch to substantially balance the temperatures of such leads and accordingly satisfactorily eliminate or cancel out the thermal EMFs in such environments. However, such above indicated disclosures do not directly pertain to a commonly utilized parallel type circuit wherein a pair of such reed switches may be placed in parallel connection with the lead wires of an external circuit for direct measurement of low level voltages or for data scanning applications.

SUMMARY OF THE INVENTION

It is accordingly the principal object of this invention to provide a parallel circuit reed relay having a pair of reed switches wherein the thermal EMF developed at junctions of dissimilar metals is eliminated or reduced to effective operational levels.

This and other objects of the invention are accomplished by the provision of a reed relay comprising a hollow body, a pair of reed switches wherein each of said switches includes first and second magnetic reeds sealingly positioned within an electrically insulated enclosure and having portions thereof extending outwardly therefrom. Each pair of said outwardly extending portions of the reeds are in turn connected to opposite sides of an electrically insulated thermally conductive member so that equal and opposite thermal electric effects will be set up on each side of the resulting parallel circuit whereby the thermal EMFs created tend to cancel each other thereby reducing the net thermal EMF across such relay construction to effective operational levels.

Other objects, features, and advantages of the invention will become apparent when the description thereof proceeds when considered in connection to accompanying illustrative drawing.

DESCRIPTION OF THE DRAWING

In the drawing which illustrate the best mode presently contemplated for carrying out the present invention:

FIG. 1 is a sectional view in somewhat stylized form of one form of the reed relay construction of the present invention;

FIG. 2 is a view similar to FIG. 1 but showing an alternate embodiment thereto;

FIG. 3 is a similar view to FIGS. 1 and 2 but showing a still further embodiment thereof; and FIG. 4 is a circuit diagram showing the parallel connection between the two reed switches in part forming the reed relay construction of the present invention.

DESCRIPTION OF THE INVENTION

A reed relay 10 constructed in accordance with the present invention is shown in FIG. 1 of the drawing having a pair of reed switches 12 electrically connected in parallel format as schematically illustrated by FIG. 4. The reed relay 10 further comprises a hollow body or bobbin construction 14 having a drive coil 16 wound about the outer surface thereof. The bobbin 14 is further provided with end flanges 17 so as to in effect form a hollow elongated enclosure 18 in which the pair of reed switches 12 are mounted. Each such reed switch 12 includes a pair of low reluctance, ferromagnetic slender flattened reeds 20 and 22, respectively. The reference numeral 20 is utilized to refer to each of a pair of first reeds which in conjunction with a pair of second reeds 22 forms the operative reed pairs 21, 23. Each pair of reeds 20, 22 is hermetically sealed within a glass tube 24 wherein first ends 26 extend outwardly therefrom through one end flange 17 of the bobbin and a pair of second ends 28 extend outwardly from the other bobbin flange. Such outward extension is facilitated by openings 30 provided within the flanges 17 in which a glass seal or the like, as is known in the art, serves to fix the position of each reed 20, 22 of the operative pairs 21, 23 thereof as they project outwardly from the bobbin enclosure. This in effect serves to space apart or otherwise normally bias the operative ends of the respective reed pairs 20, 22, it being understood that upon activation of the drive coil 16 the magnetic field that is generated causes the reeds to make electrical contact and activate the circuit, as depicted in FIG. 4 of the drawing.

The circuit shown in FIG. 4 is particularly used for switching a small signal voltage Vs, to a sensitive voltmeter Vm. At the points where the electrical conductors 32, generally formed of copper or other highly electrical conductive material, are connected to the leads of the reed switches 12 either directly, as through direct connection to the respective pairs of outwardly extending ends 26 and 28 of the reeds 20 and 22, or by means of a lead formed of the same ferromagnetic material from which the reeds are formed, junctions of dissimilar materials are formed at these points and thermal EMFs are generated which will have magnitudes that are proportional to the particular temperatures at each such juncture. Since these thermal EMFs can be designated V1(T1), V2(T2), V3(T3), and V4(T4) where T1, T2, T3, and T4 are the respective junction temperatures at junctions 1, 2, 3 and 4 depicted in FIG. 4, the voltage reading of the voltmeter Vm would be in accordance with the following formula:

$$VM = V1T1 + V2T2 + V3T3 + V4T4.$$

In such a circuit, it has been found that, if junctions 1 and 2 can be maintained at equal temperatures and that if junctions 3 and 4 can also be maintained at equal temperatures, although such temperatures may not be the same, the thermal EMF at junctures 1 and 2 will be equal and opposite and that similarly the thermal EMFs at junctures 3 and 4 will be equal and opposite so that the net contributions from these four junctions will, in the entire circuit and as indicated in the above referred to equation, balance or cancel each other. This is assuming, of course, that each of the reeds 20, 22 and any connecting leads therefor are made of the same ferromagnetic material as well as all electrical conductors 32 being formed of the same electrically conductive material, which, of course, may be quite different from that forming the reeds. Suitable electrically conductive material for the conductors 32 include copper, copper plated gold, tinned copper, pure gold, or pure silver wire, such materials being chosen so as to not create additional thermal junctions at the connections 1, 2, 3 or 4. It is also preferable that the conductors 32 be a relatively thin wire so as to avoid undue heat conduction from the outside environment.

The manner in which junctions 1 and 2 and junctions 3 and 4 are temperature equalized with each other is shown as by reference to FIGS. 1 through 3 of the drawing wherein an electrical insulating thermal conductor 36 preferably in chip form is depicted. The reed ends 26 representing junctions 1 and 2 respectively are placed in contact with opposite sides of such chip 36 by means of solder or electrically conductive adhesives. The conductors 32 may then be either placed in direct contact with ends 26, or electrically conductive contact may be made therewith by means of such solder or other conductive material. Similarly, ends 28 are so placed in contact with opposite sides of the chip 36 positioned at the other side of the relay 10.

Several materials with the desired properties of high thermal conductivity and good electrical insulation are available to form the chip 36. Examples of such materials are ceramics formed from such materials as aluminum oxide, boron nitride and beryllium oxide. Chips formed of beryllium oxide have particular utility in the present invention inasmuch as such material is readily available, has a high electrical resistivity and a high thermal conductivity similar to that of aluminum. In addition beryllium oxide has a high specific heat which gives the chip 36 some thermal inertia which tends to damp out some of the temperature fluctuations that might occur at the junctions 1 through 4.

Referring now to FIG. 2 of the drawing, it may be seen that connection of respective reed ends to the chip 36 may alternatively be made through contact with copper pins or posts 40 which are in turn mounted in a base or other supporting structure 42, in turn connected to the relay 10 as through convenient connection with the flanges 17 thereof. An alternate to the connection means shown in FIG. 2 of the drawing is presented in FIG. 3 wherein instead of a direct connection from the pairs of reed ends 26, 28 to the opposite sides of the chip 36, such connection is brought about by means of a separate lead 44 formed of the same material from which the reeds themselves are formed so as to not set up additional active thermalelectric junctions. Such leads 44 may be electrically connected to respective posts 40 either directly or by means of the electrically conductive solder or other means 38. In each such case as illustrated in FIGS. 2 and 3, posts 40 are electrically connected as by means of internal circuitry or pins to conductors 32 to complete the circuit as illustrated in FIG. 4.

The above described features of the subject reed relay construction have been found to substantially reduce the thermally unbalancing effects which may be present in the environment in which such relays are utilized.

While there is shown and described herein certain specific structure embodying the invention, it will be manifest to those skilled in the art that various modifications of the parts may be made without departing from the spirit and scope of the underlying inventive concept and that the same is not limited to the particular forms herein shown and described except insofar as indicated by the scope of the appended claims.

What is claimed is:

1. A reed relay comprising a hollow body, a pair of parallely disposed reed switches, each of said switches including first and second magnetic reeds sealingly positioned within an electrically insulated enclosure and having ends thereof extending outwardly therefrom, said switches in turn positioned within said body, and a reed drive coil supported on an outer portion of said body wherein energization of said coil causes the reeds of each switch to make contact with each other, the adjacent outwardly extending ends of said first and second reeds each respectively positioned for connection to respective pairs of lead wires with which said first and second reed ends form thermoelectrically active junctions, each pair of said first and second ends further being electrically connected to a thermally conductive, electrically insulative member whereby the thermal EMF's created at each end of the relay tend to cancel each other thereby reducing the net thermal EMF across said relay.

2. The reed relay of claim 1, each of said reeds being formed of ferro magnetic material and wherein said lead wires are formed of a common but dissimilar material whereby said thermoelectrically-active junctions form connections between the same dissimilar metals.

3. The reed relay of claim 2, said first ends and said second ends each positioned on opposite sides of said thermally conductive electrical insulator.

4. The reed relay of claim 3, wherein both said first reed ends and said second reed ends are in direct contact with respective said thermally conductive electrical insulative members.

5. The reed relay of claim 3, wherein said connections between first reed ends and said connections between second reed ends and said thermally conductive electrical insulative member is by way of pins mounted in said body and positioned on opposite sides of said member, said pins formed of the same material as said lead wires.

6. The reed relay of claim 5, wherein a lead wire formed of the same material as said reeds is attached from each of said ends thereof to respective said pins positioned on either side of said respective thermally conductive electrical insulative member connections.

7. The reed relay of claim 1, wherein said electrically insulated thermal contact is made to opposite sides of a ceramic chip.

8. The reed relay of claim 7, wherein said chip is formed of beryllium oxide.

* * * * *